United States Patent [19]

Hashimoto et al.

[11] 4,338,502

[45] Jul. 6, 1982

[54] METALLIC HOUSING FOR AN ELECTRONIC APPARATUS WITH A FLAT KEYBOARD

[75] Inventors: Shintaro Hashimoto, Shiki; Shigeki Komaki, Yamatokoriyama; Akira Tanimoto, Kashihara, all of Japan

[73] Assignee: Sharp Kabushiki Kaisha, Osaka, Japan

[21] Appl. No.: 194,379

[22] Filed: Oct. 6, 1980

Related U.S. Application Data

[62] Division of Ser. No. 33,414, Apr. 26, 1979, abandoned.

[30] Foreign Application Priority Data

Apr. 27, 1978 [JP] Japan ..... 53-57240[U]
Apr. 28, 1978 [JP] Japan ..... 53-60096[U]

[51] Int. Cl.[3] ..... H01H 13/70

[52] U.S. Cl. ..... 200/159 B; 200/5 A; 200/340

[58] Field of Search ..... 200/5 A, 5 B, 159 B, 200/340; 235/145 R

[56] References Cited

U.S. PATENT DOCUMENTS 3,627,927 12/1971 Schmitz ..... 200/5 A
3,627,935 12/1971 Spievak ..... 200/5 A
4,249,054 2/1981 Komaki ..... 200/340

FOREIGN PATENT DOCUMENTS 2338746 2/1975 Fed. Rep. of Germany ..... 200/5 A

*Primary Examiner*—John W. Shepperd
*Attorney, Agent, or Firm*—Birch, Stewart, Kolasch & Birch

[57] ABSTRACT

An upper member of a housing and a plurality of key actuators are unified into a single flat sheet made of stainless steel. The respective key actuators are made movable by providing a "U" shaped slot and a hinge at the corresponding limited regions of the stainless steel sheet. The hinge and key indicia are formed at the same time by a half etching step. When a particular one of the key actuators is actuated, a movable contact on a conductive silicon rubber sheet will come into contact with a stationary contact on a circuit board.

2 Claims, 8 Drawing Figures

METALLIC HOUSING FOR AN ELECTRONIC APPARATUS WITH A FLAT KEYBOARD

This application is a divisional of copending application Ser. No. 33,414, filed on Apr. 26, 1979, now abandoned.

BACKGROUND OF THE INVENTION

The present invention relates to an improvement in a keyboard construction and, more particularly to a keyboard construction adapted to unify an upper member of a housing for an electronic apparatus and a family of key actuators in the keyboard construction.

A conventional flat keyboard on an electronic apparatus such as a hand-held calculator includes a flexible sheet of plastic leather material constituting a plurality of movable key actuators, an upper member of a housing and a reinforcing frame for reinforcement of the flexible sheet and the upper member. The flexible sheet is sandwiched between the upper member and the reinforcing frame and secured tightly on the upper member. A sheet of nonconductive, elastic rubber and a circuit board are disposed beneath the flexible sheet. A plurality of conductive rubber bridging contacts are adhered to the nonconductive rubber sheet, each corresponding in position to stationary contacts formed on the circuit board. The rubber sheet and the circuit board are secured within a lower member of the housing by a well known manner. The plastic leather sheet, however possesses, a number of flaws, such as for example, it is frequently difficult for it to be restored from a depressed position to its initial position due to fatigue. Thus a more desirable material for the key actuator material is necessitated to overcome the deficiencies of the plastic leather sheet. Moreover, plastic leather for the key actuator material is not compatible with indicia printing. As stated above, the reinforcing frame reinforces the actuator sheet and the upper member acts to eliminate the gravity of the nonconductive rubber sheet upon the actuator sheet. To make sure that a selected or depressed key in the key construction comes into play for the introduction of inputs to the calculator, the corresponding key actuator must be rather strongly actuated to pass through a central hole of the reinforcing frame. There is, therefore, the tendency for the actuator sheet to remain depressed due to fatigue, even after the depressing action is released. Thus the appearance of the electronic apparatus is disfigured. In addition, a metallic sheet is needed within the keyboard construction for the purpose of shielding the keyboard construction against static electricity.

SUMMARY OF THE INVENTION

It is therefore on object of the present invention to provide an electronic apparatus with a flat keyboard which is free of at least one of the above suggested disadvantages in the prior art. According to the teachings of the present invention, a keyboard construction is adapted to unify a portion of a housing for an electronic apparatus such as a hand held calculator and a family of key actuators of a substantially flat keyboard into a single or common sheet. The key actuators which are integral with a portion of the housing are made of a rigid and durable metallic material, for example, stainless steel. To make the key actuators movable in a vertical direction, there are provided, in one preferred form of the present invention, four cutouts around each of a number of selected square regions of the housing/key actuator sheet corresponding to the respective regions of the key actuators. Three of the four cutouts or slots are consecutive and form a single "U" shaped slot for one of the respective, selected square regions or key actuators. The remaining one cutout is separate from the other three cutouts so that hinges are formed at the two corners of each of the selected square regions and adjacent to the remaining one cutout. The formation of these cutouts can be accomplished by a well known method such as etching. In another form of the present invention, the metallic housing/key actuator sheet is bonded to a flexible soft sheet by the use of an adhesive and there are provided four consecutive cutouts to define respective square regions of the metallic housing/key actuator sheet. The resulting independent square regions of the metallic housing/key actuator sheet serve as movable key actuators for which the flexible sheet provides a mechanical support. The metallic housing/key actuator sheet is made useful for the protection of the key construction against high static electricity by merely leading the same to the ground potential, thereby eliminating the need for a particular shield plate. It is further easy to print indicium or markings on the upper surface of the metallic housing/key actuator sheet for the respective key actuators by a well known method such as etching. A plurality of conductive, flexible rubber contacts are disposed beneath the metallic housing/key actuator sheet for up and down movement responsive to actuation of the key actuators. When a particular one of the key actuators is actuated, the corresponding conductive rubber contact comes into contact with a corresponding stationary contact disposed on a circuit board.

BRIEF DESCRIPTION OF THE DRAWINGS

The above and other objects and features of the invention will become apparent with reference to the following specification and to the drawings wherein.

DETAILED DESCRIPTION OF THE PREFERRED EMBODIMENTS

Figure 1:
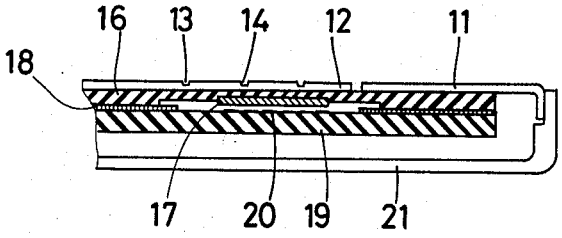
FIG. 1 is a cross sectional view of a housing with a keyboard embodying the present invention in one of its preferred forms.
Figure 2A:
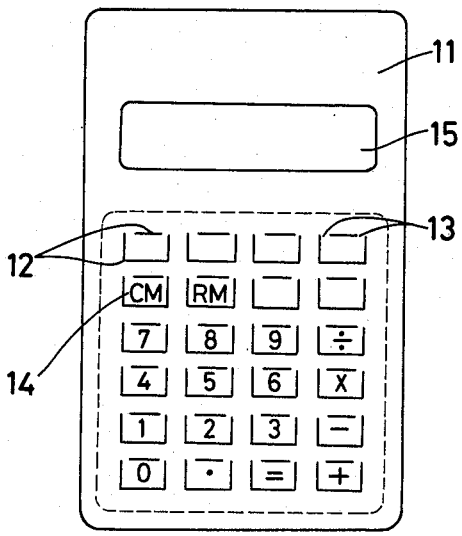
FIGS. 2(*a*) and 2(*b*) are front and rear views of an upper member of the housing according to the present invention.
Figure 2B:
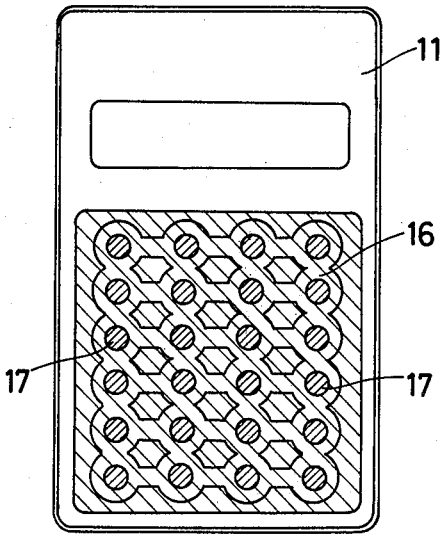
Figure 3:
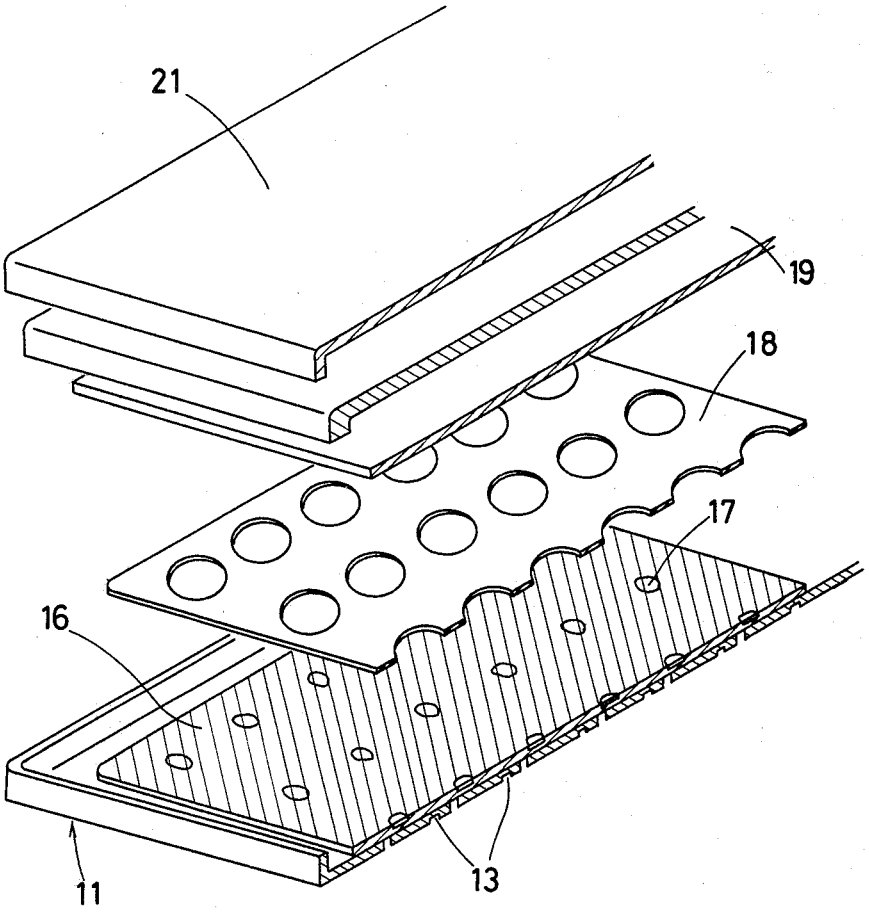
FIG. 3 is a perspective disassembled view of the one preferred form of the present invention of FIGS. 1, 2(*a*) and 2(*b*)

Referring now to FIG. 1, there is illustrated one preferred embodiment of the present invention, which comprises an upper member 11 of a housing for an electronic apparatus such as a hand-held calculator made of metallic material such as stainless steel, aluminum or the like. The metallic housing member 11 is etched to form four cutouts 12 for each of the selected square regions which serves as respective key actuators. While three of the four cutouts 12 are consecutive to form a single "U" shaped slot, the remaining one cutout 12 is separate from the other cutouts. For each of the selected square regions, the portion where no cutout is formed establishes a hinge 13. Indicia for the respective key actuators are formed by a half etching method concurrently with the formation of the hinges 13. A display window is labeled 15.

A single mold component consisting of an electrically nonconductive silicon rubber area 16 and electrically conductive silicon rubber areas 17 is disposed in the rear of the upper housing member 11. Comb-shaped stationary contacts 20 carried on a circuit board 19 are located beneath the conductive rubber areas 17, via a spacer member 18, thereby completing the formation of a substantially flat keyboard construction. The conductive rubber areas 17 bear a plurality of movable contacts which come into contact with the comb-shaped stationary contacts. These components are secured between the upper member 11 and a lower member 21 of the housing. The upper housing member 11 is provided at its periphery with a rising edge to which the lower housing member 21 is fitted tightly or bonded with an adhesive to define a cavity therebetween.

If the upper housing member 11 is 0.15 mm thick, then the front surface of the upper housing member 11 is first coated with an etching resist material except for the cutouts 12, the hinges 13, the key indicia 14 and the display window 15 and thereafter etched 0.075 mm deep (a so-called half etching). Subsequently, the rear surface of the upper housing member 11 is subjected to an etching process with an etching depth of 0.075 mm, after the deposition of an etching resist material except for the cutouts 12 and the display window 15. As a result, the cutouts 12 and the display window 15 are formed by a complete etching, whereas the hing 13 and the key indicia 14 are still 0.075 mm thick.

As stated above, according to the illustrative embodiment of the present invention, the cutouts are formed in each of the selected square regions and the key actuators are integral with the housing member thus overcoming the disadvantages with the prior art. The hinges and the key indicia are thinner than the housing member, thus making manual manipulation of the key actuator easy. It is also possible and easy to form the hinges and the key indicia at the same time. In addition, the key indicia are neither disfigured nor discolored, when the key indicia are painted in different colors for a longer period of use. Since the upper housing member is made by a metallic material, the housing may be rather thin but very durable per se and serves for the purpose of static electricity shielding. The hinges and the key indicia may be formed readily by a half etching technique, for example. These features of the present invention are differences from our copending application Ser. No. 16,075 filed on Feb. 28, 1979, and entitled METALLIC HOUSING FOR AN ELECTRONIC APPARATUS WITH A FLAT KEYBOARD.

Figure 4:
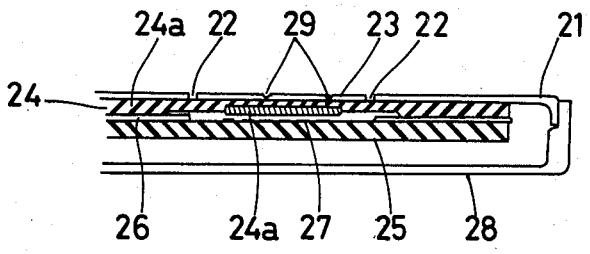
FIG. 4 is a cross sectional view of another preferred form of the present invention.
Figure 5A:
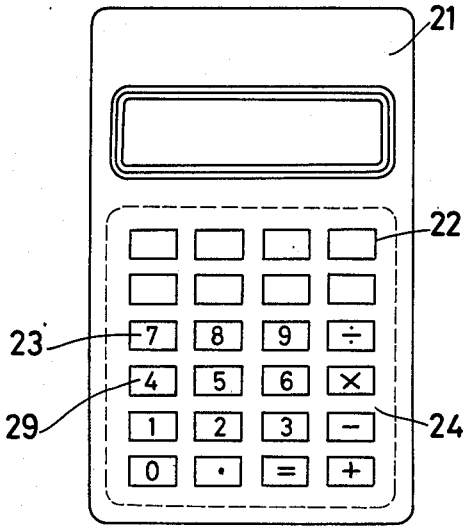
FIGS. 5(*a*) and 5(*b*) are front and rear views of an upper member of the housing in another preferred form of the present invention.
Figure 5B:
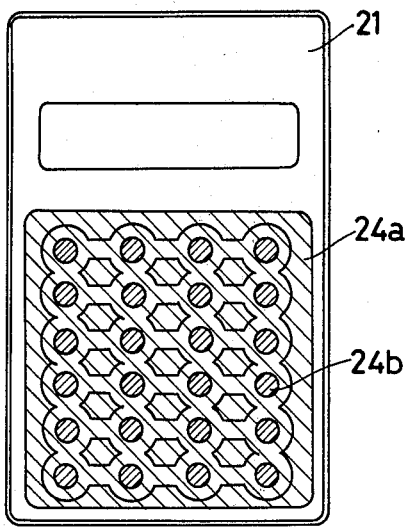
Figure 6:
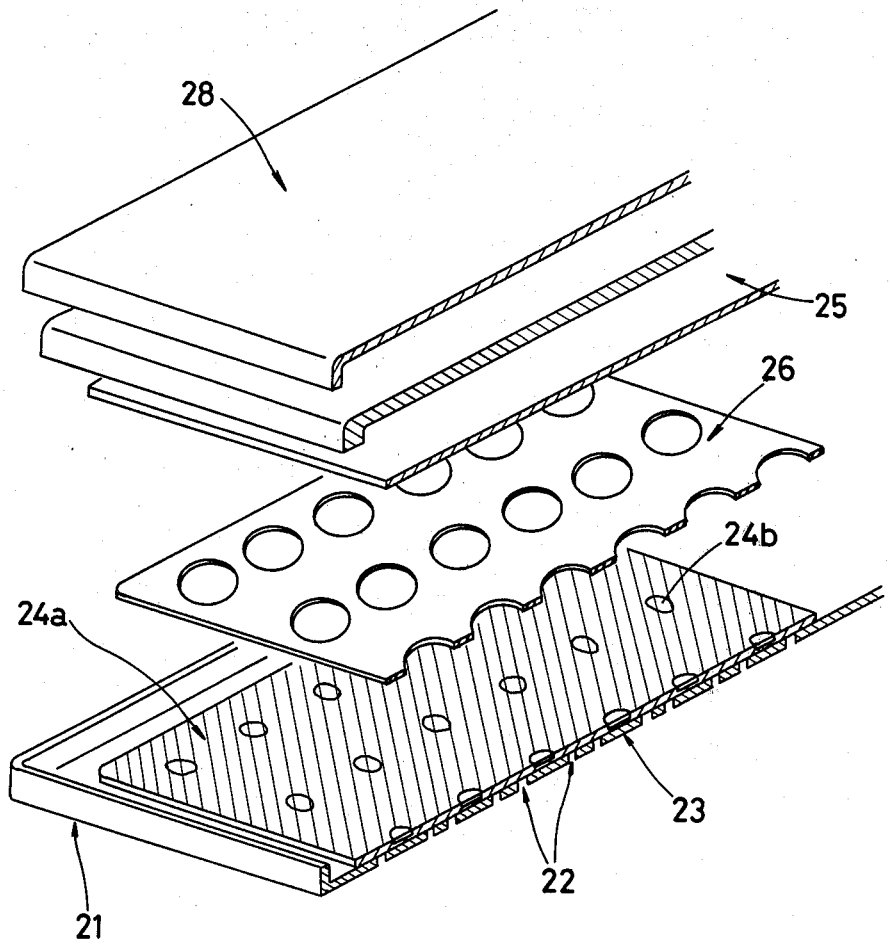
FIG. 6 is a perspective disassembled view of the other preferred form of the present invention.

Another embodiment of the present invention is illustrated in FIGS. 4 through 6. An upper housing member 21 is likewise made of stainless steel, aluminum or the like. Four consecutive cutouts 22 are formed to define selected square regions of the upper housing member 21, the selected square regions serving as key actuators 23. A flexible sheet 24 is adhered to the rear surface of the upper housing member 21 in a manner to cover all the key actuator regions. The flexible sheet 24 carries an electrically nonconductive silicon rubber sheet **24*a* and a plurality of electrically conductive silicon rubber contacts 24*b*. When the cutouts 22 are to be formed by an etching technique, the upper housing member 21 is adhesively attached to the flexible sheet 24 and the front surface of the housing member 21** is then subjected to the etching step.

A circuit board 25 is disposed immediately beneath the lower surface of the flexible sheet 24 via a spacer member 26. The keying operation is achieved by contacting the electrically conductive silicon rubber contact **24*a* with the associated stationary contacts 27 on the circuit board 25. A lower member of the housing is labeled 28 and key indicia made through the etching process are labeled 29**.

The invention being thus described, it will be obvious that the same may be varied in many ways. Such modifications are not to be regarded as a departure from the spirit and scope of the invention, and all such modifications are intended to be included within the scope of the following claims.

We claim:

1. A hand-held electronic calculator having a keyboard comprising:

a housing having an upper member and a lower member for said hand-held electronic calculator, said upper member being made of metallic material;

said upper metallic housing member of said housing constituting a plurality of key actuators, each of said key actuators being defined by a continuous slot which connects with itself and completely penetrates the upper metallic housing member;

a flexible sheet fixed to the rear surface of the upper metallic housing member in a manner to cover all of the key actuators, said flexible sheet carrying an electrically non-conductive silicon rubber sheet and a plurality of electrically conductive silicon rubber contacts forming the movable contacts for the keyboard; and a plurality of stationary contacts including means for their support, disposed within said housing, said stationary contacts being positioned to correspond to said movable contacts, whereby a particular movable contact comes into contact with a particular stationary contact when a particular one of said key actuators is depressed.

2. The hand-held electronic calculator of claim 1, wherein each key actuator is defined by four slots which connect with each other to form a square or rectangular configuration.

* * * * *